US009466876B2

(12) United States Patent
Kerselaers et al.

(10) Patent No.: US 9,466,876 B2
(45) Date of Patent: Oct. 11, 2016

(54) ANTENNA

(71) Applicant: NXP B.V., Eindhoven (NL)

(72) Inventors: Anthony Kerselaers, Herselt (BE); Liesbeth Gomme', Anderlecht (BE)

(73) Assignee: NXP B.V., Eindhoven (NL)

( * ) Notice: Subject to any disclaimer, the term of this patent is extended or adjusted under 35 U.S.C. 154(b) by 109 days.

(21) Appl. No.: 14/450,508

(22) Filed: Aug. 4, 2014

(65) Prior Publication Data

US 2015/0042524 A1 Feb. 12, 2015

(30) Foreign Application Priority Data

Aug. 8, 2013 (EP) ..... 13179741

(51) Int. Cl.
*H01Q 1/27* (2006.01)
*H01Q 1/24* (2006.01)
(Continued)

(52) U.S. Cl.
CPC ..... *H01Q 1/273* (2013.01); *H01Q 1/245* (2013.01); *H01Q 9/26* (2013.01); *H04R 25/554* (2013.01); *H04R 2225/51* (2013.01)

(58) Field of Classification Search
CPC ..... H01Q 1/27
USPC ..... 343/718
See application file for complete search history.

(56) References Cited

U.S. PATENT DOCUMENTS

2006/0220971 A1* 10/2006 Sato ..... G04G 21/04 343/718
2010/0158293 A1* 6/2010 Polinske ..... H01Q 1/243 381/315
2011/0156977 A1* 6/2011 Diaz ..... H01Q 9/0421 343/772

FOREIGN PATENT DOCUMENTS

EP 0 637 094 A1 2/1995
EP 1 646 107 A2 4/2006
EP 2 200 120 A2 6/2010
(Continued)

OTHER PUBLICATIONS

Conway, G. A., et al; "An Analytical Path-Loss Model for On-Body Propagation"; 2010 URSI Int'l. Symposium on Electromagnetic Theory; IEEE; pp. 332-335 (2010).
(Continued)

*Primary Examiner* — Dameon E Levi
*Assistant Examiner* — Andrea Lindgren Baltzell

(57) ABSTRACT

An antenna comprises first and second conducting elements and first, second and third conducting lines. Each conducting element has a conductive surface. The first conducting line provides a short circuit between the conductive surfaces. The second conducting line has a first end electrically connected to one conductive surface and a second, free end. The third conducting line has a first end electrically connected to the other conductive surface and a second, free end. The second and third conducting lines are aligned along an axis X-X and each of the second ends of the second and third conducting lines serves as one of the terminals of a two terminal port F for feeding an RF signal of wavelength λ to the antenna. The first and second conducting elements are arranged with the conductive surfaces a face-to-face relationship, spaced apart by a distance d and the first, second and third conducting lines are arranged such that, when an RF signal is fed to the antenna, currents caused to flow in one conductive surface generate a magnetic field that at least partially cancels out the magnetic field generated by currents caused to flow in the other conductive surface and currents are caused to flow in the first, second and third conducting lines.

20 Claims, 6 Drawing Sheets

(51) Int. Cl.
*H01Q 9/26* (2006.01)
*H04R 25/00* (2006.01)

(56) References Cited

FOREIGN PATENT DOCUMENTS

| | | | |
|---|---|---|---|
| EP | 2 765 659 | A1 | 2/2013 |
| EP | 2 765 650 | A1 | 8/2014 |
| WO | 2010/025470 | A2 | 3/2010 |

OTHER PUBLICATIONS

Conway, Gareth A., et al; "An Antennas and Propagation Approach to Improving Physical Layer Performance in Wireless Body Area Networks"; IEEE Journal on Selected Areas in Communications, vol. 27, No. 1; 10 pages (Jan. 2009).
Extended European Search Report for Application No. 13179741.7 (Jan. 13, 2014).

* cited by examiner

ANTENNA

CROSS-REFERENCE TO RELATED APPLICATIONS

This application claims the priority under 35 U.S.C. §119 of European patent application no. 13179741.7, filed on Aug. 8, 2013, the contents of which are incorporated by reference herein.

TECHNICAL FIELD

The invention relates to an antenna. In particular, although not exclusively, the invention relates to an antenna for a body-mounted wireless communication device, that is to say, a device with a wireless communications capability, which is intended when in use to be worn or mounted on or located in close proximity to a person. A behind-the-ear hearing aid that communicates wirelessly at radio frequencies is an example of such a device. The invention also relates to a body-mounted wireless communication device and to methods of making an antenna and a body-mounted wireless communication device.

BACKGROUND ART

A hard-of-hearing person may wear two behind-the-ear hearing aids; one behind each ear. One of the hearing aids (the transmitting hearing aid) may pick up an acoustic signal and convert it to an electrical signal that may be wirelessly transmitted to the other hearing aid (the receiving hearing aid). In each hearing aid, the electrical signal may be amplified and converted back to an acoustic signal which may be played into the corresponding ear of the wearer.

It is known to communicate wirelessly between transmitting and receiving hearing aids by means of magnetic induction. A coil in the transmitting hearing aid may generate a magnetic field that passes through the wearer's head to the receiving hearing aid which has a receiving coil.

It is desirable for the transmitting hearing aid to be able to communicate not only with the receiving hearing aid but also with other, non-body mounted devices, remote from the wearer, such as, for example, televisions, radios or telephones. Some such devices may be bandwidth "hungry". Whilst magnetic induction is fine for hearing aid-to-hearing aid wireless communication, its short range capability (typically less than 1 m) and its limited bandwidth (typically somewhere in the region of 10 to 13 MHz) make it unsuitable for communicating wirelessly with remote, bandwidth "hungry" devices. In those circumstances, it is preferred to communicate using electromagnetic radiation in the radio spectrum, which performs much better from the bandwidth and range perspective, such as, for example, the 2.5 GHz ISM (industrial, scientific and medical) radio band. However, RF (radio frequency) signals in this band (and other bands) are absorbed by the head, which poses a challenge for hearing aid-to-hearing aid communication.

It is known that one body-mounted wireless device may communicate efficiently with another such device mounted on the same body when each device has its antenna arranged so that the direction of the electric (E) field vector of the RF signal emitted by the antenna is more or less normal to the surface of the body at the position where the device is mounted. In the case of hearing aids, this means the direction of the E field vector needs to be normal to the plane of the wearer's ear or, to put it another way, parallel to an axis extending through the wearer's ears. For an elongate, linear antenna, such as a monopole or dipole antenna, the current flowing in the antenna generates an E field vector whose direction is parallel to the antenna's longitudinal axis. Hence, if a linear antenna was to be used in a hearing aid, the longitudinal axis of the antenna would need to be arranged normal to the wearer's head. However, at an operating frequency of around 2.5 GHz, which equates to a wavelength, $\lambda$, of 12 cm, a linear antenna would need to be a minimum of around 6 cm long ($\frac{1}{2}\lambda$ which, for a behind-the-ear hearing aid, would not be practical.

What is required is an antenna that is suitable for use in a body mounted wireless communication device, such as a behind-the-ear hearing aid, operating at radio frequencies.

SUMMARY OF INVENTION

According to a first aspect there is provided an antenna comprising: a first conducting element having a conductive surface; a second conducting element having a conductive surface; a first conducting line providing a short circuit between the conductive surfaces; a second conducting line having a first end electrically connected to one conductive surface and a second, free end; a third conducting line having a first end electrically connected to the other conductive surface and a second, free end; wherein the second and third conducting lines are aligned along an axis and each of the second ends of the second and third conducting lines serves as one of the terminals of a two terminal port for feeding an RF signal of wavelength $\lambda$ to the antenna, and wherein the first and second conducting elements are arranged with the conductive surfaces in a face-to-face relationship, spaced apart by a distance d, and the first, second and third conducting lines are arranged such that, when an RF signal is fed to the antenna, currents caused to flow in one conductive surface generate a magnetic field that at least partially cancels out the magnetic field generated by currents caused to flow in the other conductive surface, currents are caused to flow in the first, second and third conducting lines, the currents caused to flow in the second and third conducting lines having two components, a first component generating a magnetic field that at least partially cancels out the magnetic field generated by the same current flowing in the first conducting line and a second component acting as the effective antenna current that generates an E-field vector with a direction along the axis of alignment of the second and third conducting lines.

An antenna according to a first aspect is particularly suitable for use in a body-mounted wireless communication device. The antenna may be incorporated into the device such that, when the device is worn, the axis of alignment of the second and third conducting lines, that is, the direction of E field vector of the antenna, may be normal to the body of the wearer, which, as discussed above, is optimum for wireless communication between two body-mounted devices.

The shape of the conducting elements, and hence the conductive surfaces, is not crucial to the operation of the antenna; the conducting elements can be any of a wide variety of shapes, which is beneficial in terms of the adaptability of the antenna to being incorporated into, for example, a body-mounted wireless communication device. What is more important is that the two conducting elements are the same or virtually the same size and shape (physically or electrically), which affects the extent of cancelling of the magnetic fields between the conducting elements; the more closely similar the size and shape, the greater the extent of cancelling. The antenna will still work effectively if the conducting elements are not the same size and shape and only partial cancelling is achieved; the extent of cancelling needs to be such that any residual current is insignificant in terms of the effective antenna current. Aptly, the conducting elements are more than around about 70% the same size and shape.

In order for the conducting elements to resonate, so that the antenna performs as an antenna, the electrical length of the conducting elements has to be close to ½λ (or multiples thereof). The greater the area of the conductive surface, the less than ½λ the physical length of the conducting element may be. For example, if the conductive surface has a large surface area, say because the conducting element is a relatively wide strip, its length may be between ¼λ and ½λ.

The conductive surfaces may be arranged parallel to one another. It is not essential to the operation of the antenna that the conductive surfaces are parallel, but the nearer to parallel they are, the greater the extent of magnetic cancelling between them. Again, the extent of cancelling needs to be such that any residual current is insignificant in terms of the effective antenna current. The conductive surfaces may be planar, but equally they may be non-planar surfaces which match, such as, for example, undulating surfaces with their undulations arranged such that the distance d between the surfaces remains approximately constant.

The space between the conductive surfaces may include other electrical components and/or devices and/or other solid items such as, for example, electrical signal processing circuitry and/or a radio integrated circuit (IC). Anything in the space between the conductive surfaces may affect the behaviour of the antenna. Indeed, solid items in the space may be used intentionally to affect the behaviour of the antenna. The presence of solid items in the space may affect the capacitance between the conducing elements.

Aptly, each conducting element comprises a thin copper film. But each conducting element could equally well comprise another form, such as, for example, a plate, and/or another conductive material.

Aptly, the combined length of the first, second and third conducting lines is less than ¼λ. If the combined length of the first, second and third conducting lines is in the order of ¼λ, they may start to function as an antenna in their own right, which is undesirable. The first conducting line may be less than or equal to 3/20λ long. In other words, when the first conducting line is arranged normal to the first and second conducting elements, the spacing d between them may be less than or equal to 3/20λ, which is particularly suitable when the antenna is used at radio spectrum frequencies in, for example, a behind the ear hearing aid where spacing is tight. One or both of the first conducting line and the axis of alignment of the second and third conducting lines may be arranged normal to at least one conducting surface. The first conducting line and second and third conducting lines may be parallel. The magnetic field cancelling will be most effective when the first and second and third conducting lines are parallel, but this is not essential. The spacing between the first conducting line and the second and third conducting lines is limited by the extent over which the magnetic fields around each of the conducting lines may interact in a manner that causes them to cancel each other out.

Each conductive surface may have a length and the conductive surfaces may be the same length, and the length may be selected and the first conducting line may be positioned thereby to determine the resonant frequency of the antenna.

The first, second and third conducting lines may be positioned thereby to determine the input impedance of the feeding port. A capacitance may be connected across the terminals of the feeding port to affect the input impedance of the feeding port.

According to a second aspect there is provided a body mounted device comprising an antenna according to the first aspect.

The device may comprise a housing having two opposed walls, wherein each of the first and second conducting elements may be provided on one of the two opposing walls.

According to a third aspect there is provided a method of making an antenna according to the first aspect.

According to a fourth aspect there is provided a method of making a body-mounted device according to the second aspect.

DESCRIPTION OF EMBODIMENTS

Figure 1:
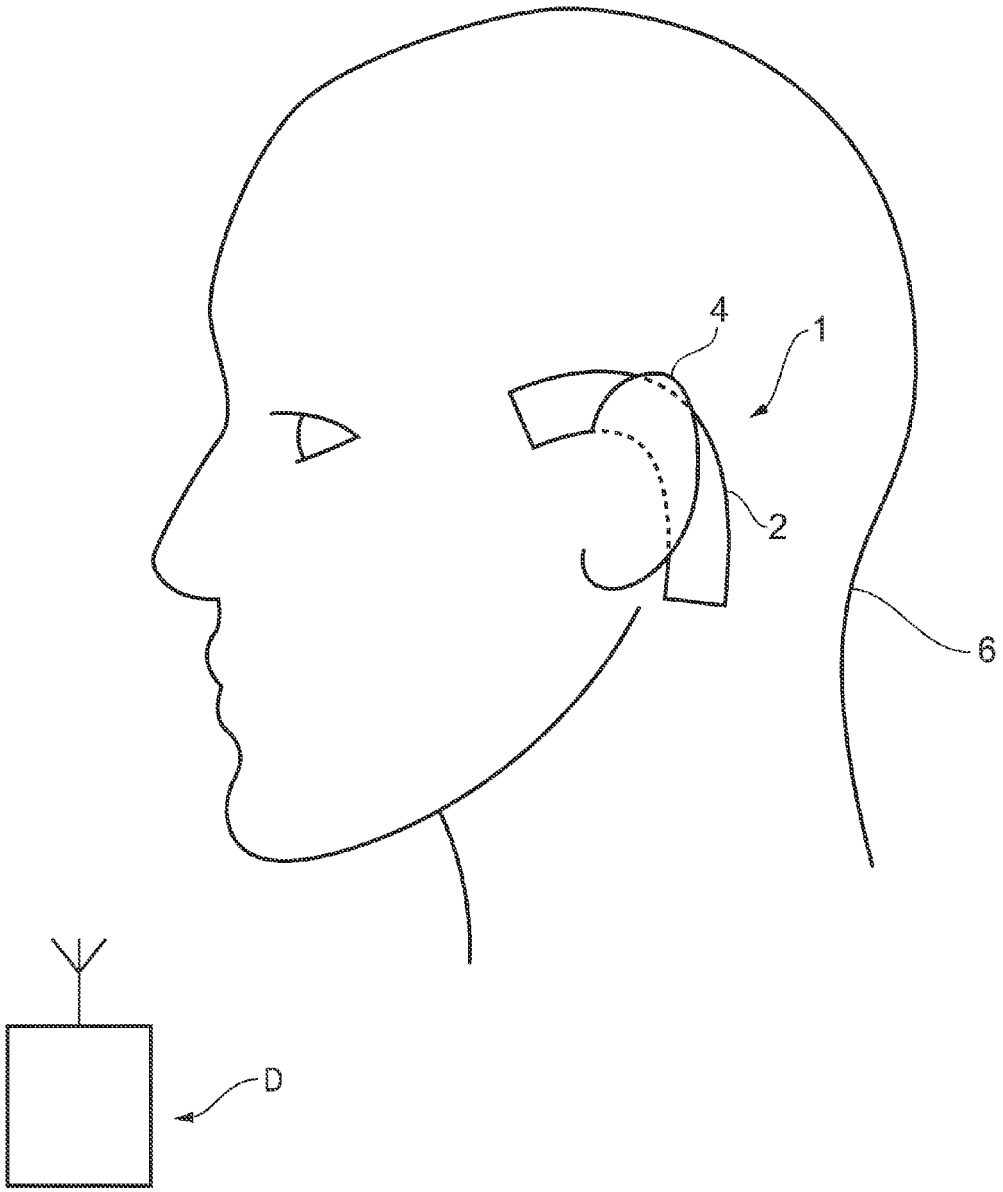
FIG. 1 is a side view of a person wearing a hearing aid incorporating an antenna according to an aspect of the invention.

With reference to FIG. 1, a first behind-the-ear hearing aid, indicated generally at 1, has a hollow, box-like body 2 which is generally arcuate in shape when viewed from the side so as fit snugly behind an ear 4 of a hard-of-hearing person 6. As well as amplifying acoustic signals for the benefit of the person 6, the hearing aid 1 communicates wirelessly with another hearing aid (not shown), behind the other ear of the person 6, and a remote, non-body-mounted device D. Housed within the body 2 of the first hearing aid 1 for these purposes are a microphone (not shown), electrical signal processing circuitry (not shown), a radio IC (not shown), an antenna and an earpiece (not shown).

Figure 2:
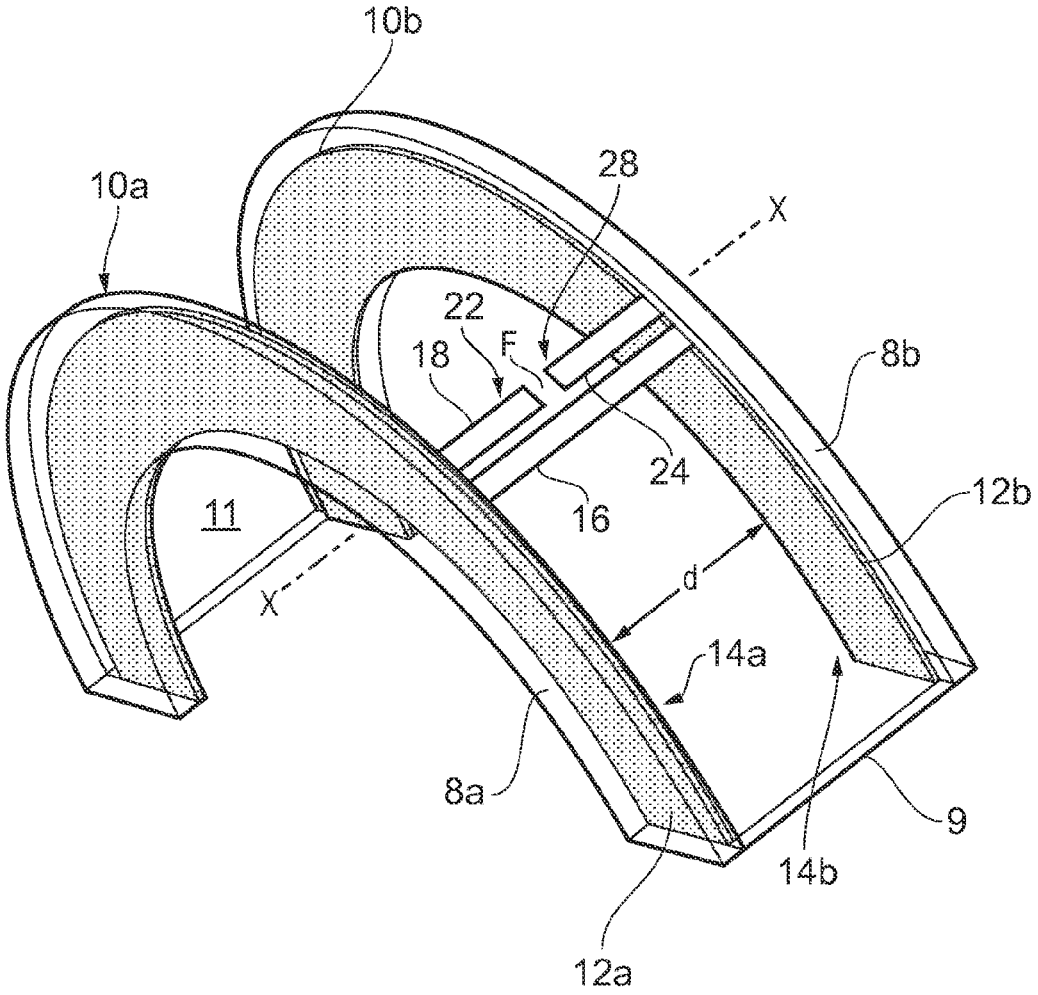
FIG. 2 is a perspective view of the side and top walls of the hearing aid of FIG. 1, shown as though transparent to facilitate illustration of the conducting elements and the conducting lines of an antenna according to an aspect of the invention and their position in relation to the walls.

With reference also to FIG. 2, the body 2 of the first hearing aid 1 comprises first and second generally C-shaped side walls 8*a*, 8*b* (illustrated as see-through) spaced apart by a distance d, with opposing first and second inside surfaces 10*a*, 10*b* respectively. The body 2 also has a curved top wall 9 (illustrated as see-through), between the side walls 8*a*, 8*b*, with an inside surface 11. In addition, the body 2 has bottom and end walls which, for clarity, are not shown. The electrical signal processing circuitry, the radio IC and other solid items would, in the finished hearing aid, be located in the spacing between the first and second side walls 8*a*, 8*b*, but, also for clarity, they are not shown.

Thin copper films applied to each of the first and second inside surfaces 10*a*, 10*b* of the first and second side walls 8*a*, 8*b* form first and second plane conducting elements 12*a*, 12*b* respectively of the antenna. The copper films are applied to all but a fixed-width narrow margin around the edge of the side walls 8*a*, 8*b* and, with the side walls 8*a*, 8*b* being the same size and shape, the first and second conducting elements 12*a*, 12*b* are the same size and shape. Each of the first and second conducting elements 12*a*, 12*b* has an exposed conductive surface 14*a*, 14*b* and, with the conducting elements 12*a*, 12*b* being arranged on the opposed first and second inside surfaces 10*a*, 10*b* of the first and second side walls 8*a*, 8*b* respectively, the conductive surfaces 14*a*, 14*b* are in a in a face-to-face relationship. The side walls 8*a*, 8*b*, and hence the conductive surfaces 14*a*, 14*b*, are parallel to one another.

A first copper strip conducting line 16, applied to the inside surface 11 of the top wall 9, provides a short circuit between the first and second conductive surfaces 14*a*, 14*b*. In other words, the first conducting line 16 is electrically connected to both conductive surfaces 14*a*, 14*b*. A second copper strip conducting line 18, applied to the inside surface 11 of the wall 9, in close proximity to but spaced apart from the first conducting line 16, has a first end connected to the first conductive surface 14*a* and a second free end 22. A third copper strip conducting line 24, applied to the inside surface 11 of the wall 9, in close proximity to but spaced apart from the first conducting line 16, has a first end connected to the second conductive surface 14*b* and a second free end 28. The second and third conducting lines 18, 24 are aligned along an axis X-X and extend from their respective side walls 8*a*, 8*b* to positions such that there is a small gap between their two second ends 22, 28. The first conducting line 16 is arranged normal to the walls 8*a*, 8*b*/conductive surfaces 14*a*, 14*b*, as is the alignment axis X-X. Hence, the first conducting line 16 and the second and third conducting lines 18, 24 are parallel to one another.

Figure 3:
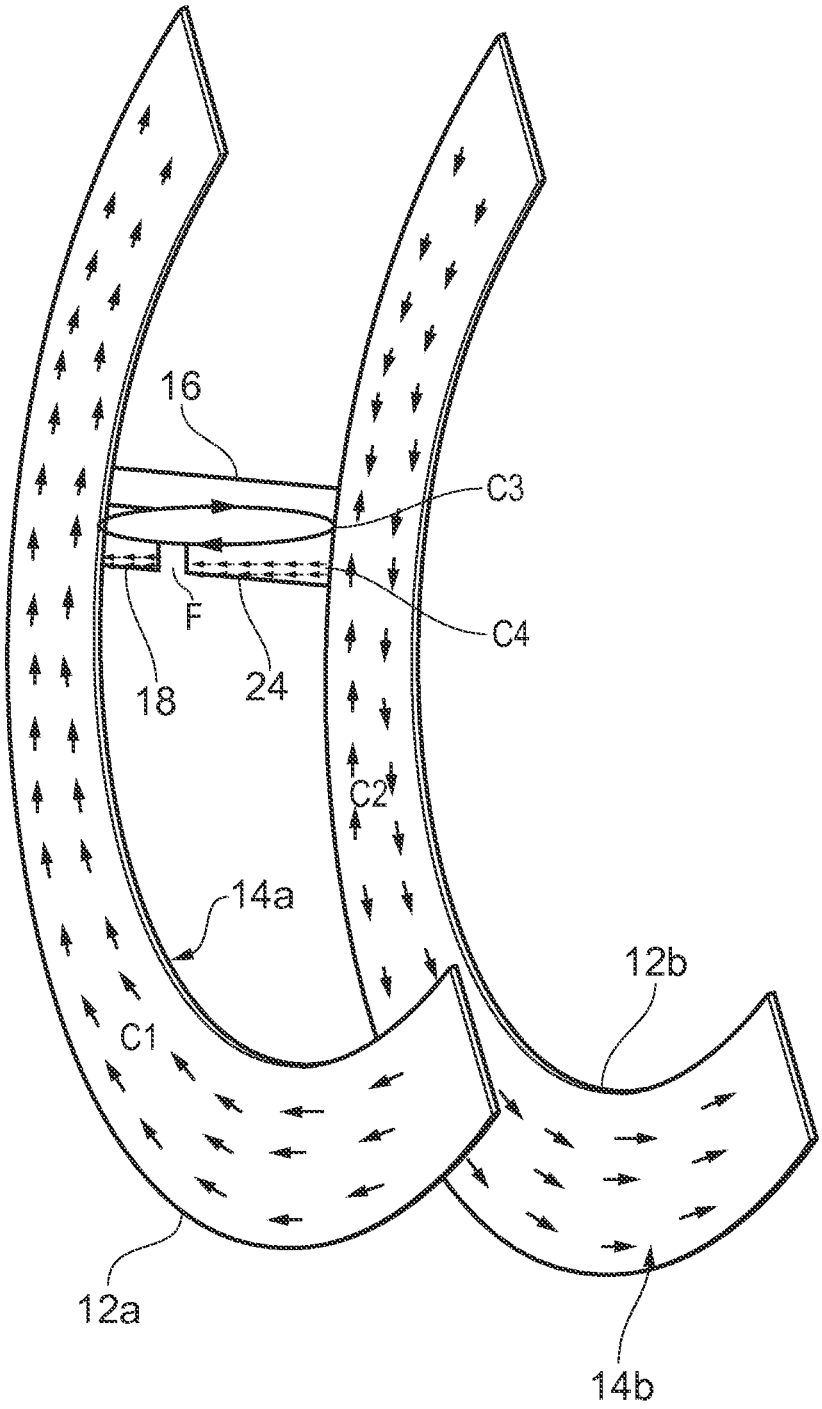
FIG. 3 is a schematic illustration of the current flows in the conducting elements and conducting lines of an antenna according to an aspect of the invention, in transmission mode with an RF signal fed to the antenna.

Each of the second ends 22, 28 of the second and third conducting lines 18, 24 serves as one of the terminals of a two-terminal port F for feeding an RF signal of wavelength λ to the antenna. In the transmitting mode of the hearing aid 1, an RF signal generated by the radio IC connected to the port F causes currents to flow in the first, second and third conducting lines 16, 18, 24 and the first and second conductive surfaces 14*a*, 14*b* as shown in FIG. 3. The arrows in FIG. 3 show the general direction of current flow.

The combined length of the first, second and third conductors 16, 18, 24 is less than ¼λ and the length of the first conductor 16, or spacing d, is less than 3/20λ. Consequently, the port F "sees" a closed circuit formed by the first, second and third conducting lines 16, 18, 24 that is considerably smaller than ½λ.

Currents C1, C2 caused to flow in the first and second conductive surfaces 14*a*, 14*b* respectively generate magnetic fields that cancel each other out. The magnetic fields may only partially cancel each other out due to, amongst other things, the first and second conducting surfaces 14*a*, 14*b* being other than exactly parallel and variations in their spacing, but the extent of cancelling is such that any residual current is insignificant in terms of the effective antenna current.

Two components of current are caused to flow in the second and third conducting lines 18, 24. The first component C3 flows in the inner side of the second and third conducting lines 18, 24 and also flows in the first conducting line 16. The first component C3 generates local magnetic fields around the first and second and third conducting lines 16, 18, 24. As a result of the first, second and third conducting lines 16, 18, 24 being arranged closely spaced apart in parallel, the magnetic fields cancel each other out. The magnetic fields may only partially cancel each other out due to, amongst other things, the first, second and third conducting lines 16, 18, 24 being other than exactly parallel and variations in their spacing; the magnetic fields may only cancel each other partially, but the extent of cancelling is such that any residual current is insignificant in terms of the effective antenna current.

A second component of current C4 is caused to flow in the outer sides of the second and third conducting lines 18, 24 as a result of the interface between the radio IC and the feeding port F. This second component C4 generates a magnetic field that is not cancelled out. Accordingly, the second component C4 is the effective antenna current and because it is aligned with the axis X-X that is normal to the side walls 8*a*, 8*b*, it has an E field vector whose direction is normal to the walls 8*a*, 8*b*. Thus, with one of the side walls 84, 8*b* against the wearer's head, the direction of the E field vector will be normal to wearer's head, which facilitates efficient communication with the second hearing aid on the other side of the wearer's head. The component C4 may be varied by changing the interface between the radio IC and the feeding port F.

The resonant frequency of the antenna is determined by the size and shape of the first and second conductive surfaces 14*a*, 14*b* and the position of the first conducting line 16. In one example embodiment of a hearing aid, of the same construction as the hearing aid illustrated in FIGS. 1 to 3, for use with an RF signal of frequency 2.5 GHz, the first and second conducting elements 12*a*, 12*b* have an arc length of about 40 mm and each of the first and second conducting elements 12*a*, 12*b* is 2 mm wide. The first conducting line 16 is located about half way along the first and second conducting elements 12*a*, 12*b*. The spacing d between the first and second conducting elements 12*a*, 12*b* is 4.9 mm. The first, second and third conducting lines 16, 18, 24 are 0.25 mm wide and there is a 1 mm gap between the second ends 22, 28 of the second and third conducting lines 18, 24. The first conducting line 16 and the second and third conducting lines 18, 24 are spaced 1 mm apart. The copper film of the first and second conducting elements 12*a*, 12*b* is 0.1 min thick and the copper strip of the first, second and third conducting lines 16, 18, 24 is 0.25 mm thick.

Figure 4:
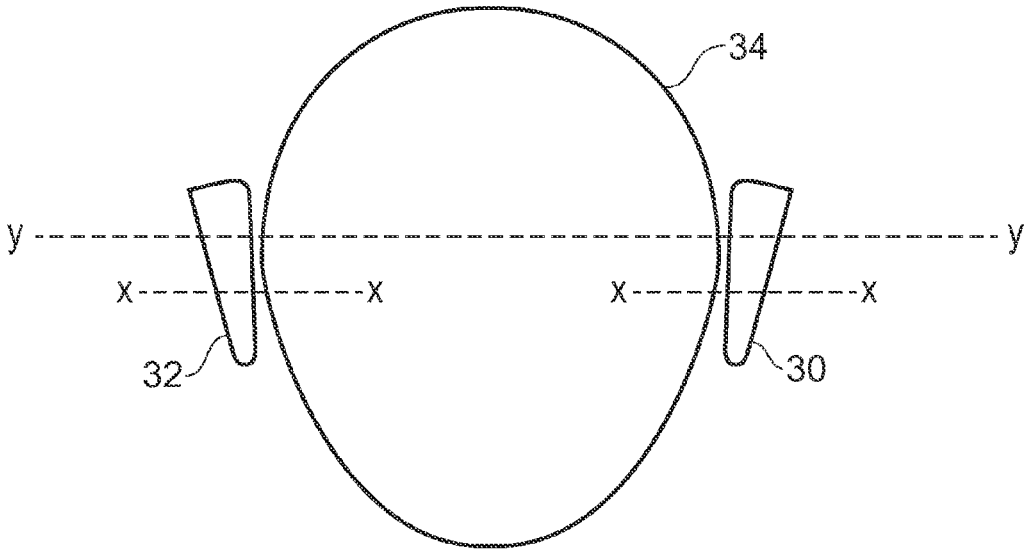
FIG. 4 is a top view of the phantom head of a person wearing two hearing aids, each according to one aspect attic invention.
Figure 5:
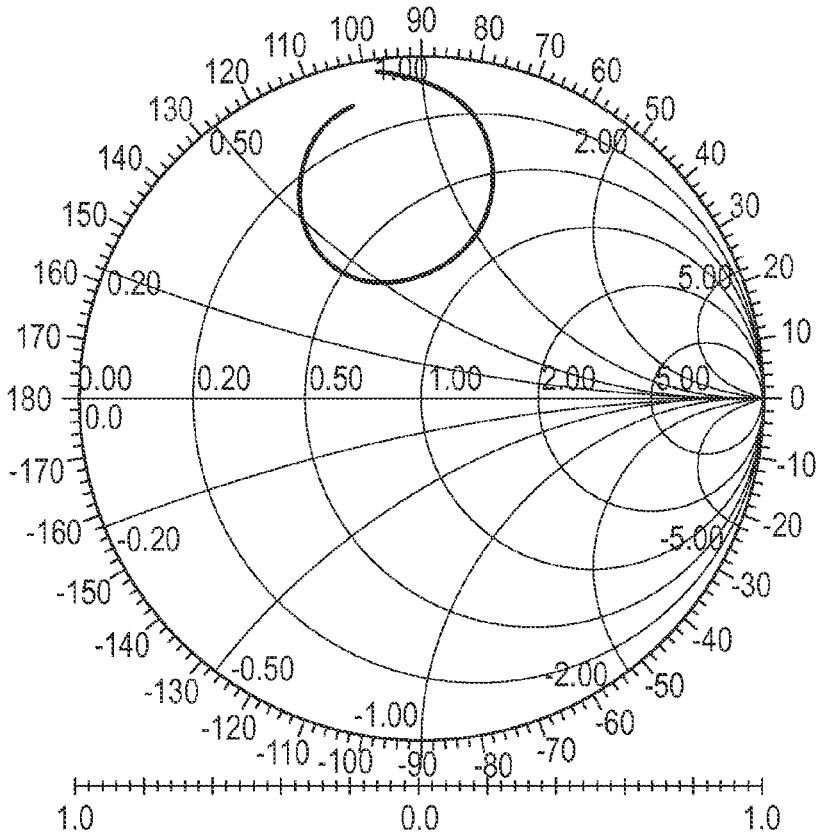
FIG. 5 is a Smith plot of the simulated input reflection coefficient of the antenna of one of the hearing aids shown if FIG. 4.
Figure 6:
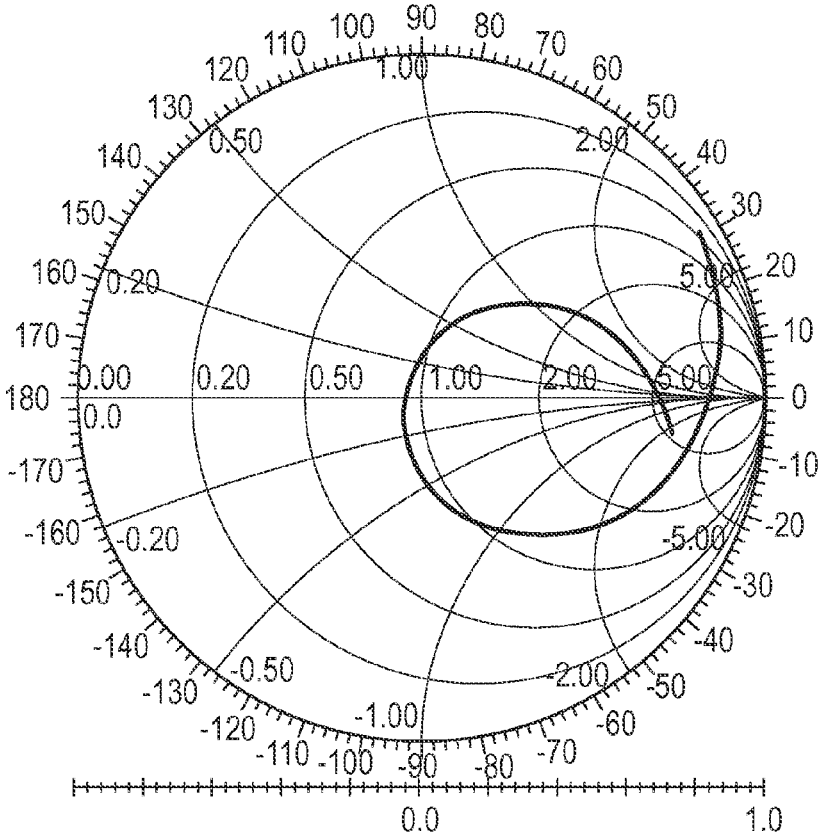
FIG. 6 is a Smith plot of the simulated input reflection coefficient of the antenna of one of the hearing aids shown in FIG. 4 after matching.
Figure 7:
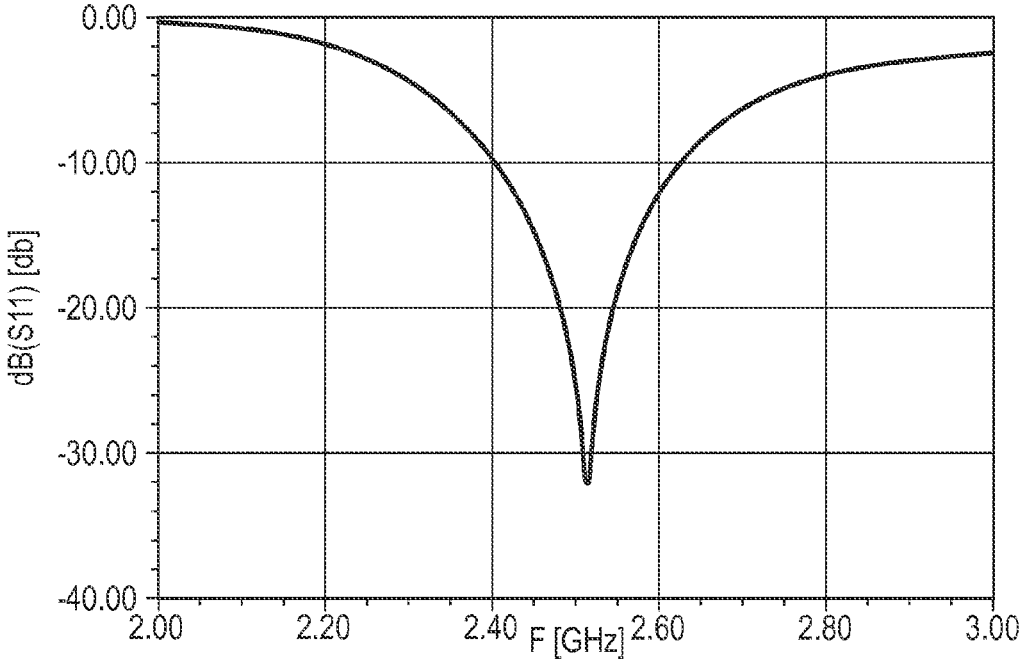
FIG. 7 is a graph of the simulated input reflection coefficient near the phantom head of the antenna of one of the hearing aids shown in FIG. 4 after matching.
Figure 8:
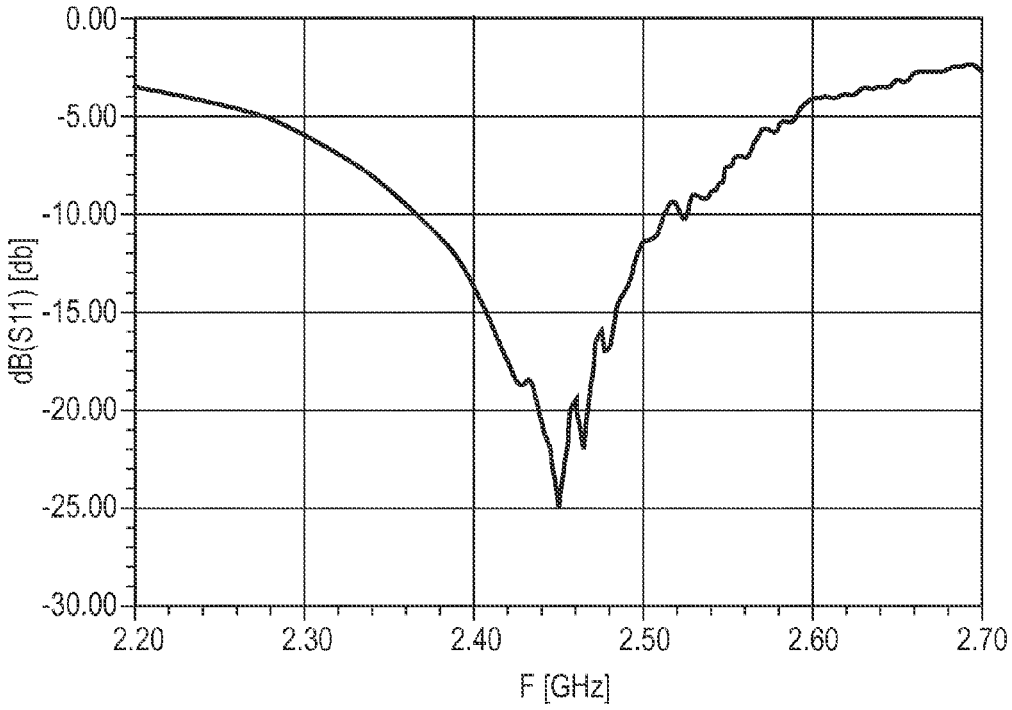
FIG. 8 is a graph of measured input reflection coefficient of an antenna of an actual hearing aid near a phantom head after matching.

With reference to FIG. 4, for simulation purposes, a model was created consisting of two behind-the-ear hearing aids 30, 32, each of the same dimensions as the example embodiment, and a phantom head 34. The hearing aids 30, 32 were placed on either side of the phantom head 34 with their X-X axes parallel with the axis Y-Y passing through both ears of the phantom head 34. A simulation of one of the hearing aids 30, 32 in operation was then run. FIG. 5 is a Smith plot from the simulation showing that the impedance of the antenna was inductive. The simulation was re-run after matching the antenna with a capacitance placed across the feeding port F. FIG. 6 is a Smith plot from the simulation showing the impedance of the antenna after matching with the capacitance. FIG. 7 is a plot of the simulated input reflection coefficient in decibels near the phantom head after matching with the capacitance. FIG. 8 is a plot of the measured input reflection coefficient of a hearing aid made according to the example embodiment near the phantom head after matching with the capacitance.

The invention claimed is:

1. An antenna comprising:

a first conducting element having a first conductive surface;

a second conducting element having a second conductive surface;

a first conducting line providing a short circuit between the first and second conductive surfaces;

a second conducting line having a first end electrically connected to the first conductive surface and a second, free end;

a third conducting line having a first end electrically connected to the second conductive surface and a second, free end; wherein the second and third conducting lines are aligned along an axis and each of the second ends of the second and third conducting lines serves as one of the terminals of a two terminal port for feeding a radio frequency (RF) signal of wavelength λ to the antenna, and wherein the first and second conducting elements are arranged with the first and second conductive surfaces in a face-to-face relationship, spaced apart by a distance d, and the first, second and third conducting lines are arranged such that currents flow, in response to the feeding of a RF signal to the antenna, in the first conductive surface generate a magnetic field that at least partially cancels out the magnetic field generated by currents caused to flow in the second conductive surface, and currents are caused to flow in the first, second and third conducting lines, the currents caused to flow in the second and third conducting lines having two components, a first component generating a magnetic field that at least partially cancels out the magnetic field generated by the same current flowing in the first conducting line and a second component acting as the effective antenna current that generates an E-field vector along the axis of alignment of the second and third conducting lines.

2. An antenna according to claim 1, wherein the first and second conductive surfaces are the same size and shape.

3. An antenna according to claim 1, wherein the first and second conductive surfaces are parallel and non-co-planar.

4. An antenna according to claim 1, wherein the first and second conductive surfaces are matching, non-co-planar surfaces.

5. An antenna according to claim 1, wherein the space between the first and second conductive surfaces includes electrical components and/or devices and/or other solid items.

6. An antenna according to claim 1, wherein the combined length of the first, second and third conducting lines is less than ¼λ.

7. An antenna according to claim 6, wherein the first conducting line is less than or equal to 3/20λ.

8. An antenna according to claim 1, wherein the first conducting line and/or the axis of alignment of the second and third conducting lines are arranged normal to at least one of the first and second conductive surfaces.

9. An antenna according to claim 1, wherein a first conducting line alignment axis of the first conducting line is parallel to a second conducting line alignment axis of the second conducting line, and the first conducting line alignment axis of the first conducting line is parallel to a third alignment axis of the third conducting lines.

10. An antenna according to claim 1, having a resonant frequency, wherein the first and second conductive surfaces are the same length, and the length is selected and the first conducting line is positioned thereby to determine the resonant frequency.

11. An antenna according to claim 1, wherein the feeding port has input impedance, and the first, second and third conducting lines are spaced apart thereby to determine the input impedance.

12. An antenna according to claim 1, wherein a capacitor is connected across the terminals of the feeding port.

13. A body-mounted device comprising an antenna according to claim 1.

14. A body-mounted device according to claim 13, further comprising a housing having two opposing walls, wherein each of the first and second conducting elements is provided on one of the two opposing walls.

15. A method of making an antenna according to claim 1.

16. An antenna according to claim 1, wherein the first and second conductive surfaces are matching, undulating surfaces having undulations arranged such that a distance between the undulating surfaces remains approximately constant.

17. An antenna according to claim 1, wherein a first conducting line alignment axis of the first conducting line is parallel to a second conducting line alignment axis of the second conducting line, and the first conducting line alignment axis of the first conducting line is parallel to a third alignment axis of the third conducting lines.

18. An antenna according to claim 1, wherein the second conducting line and the third conducting line are arranged such that the first end of the second conducting line is distal, along the axis, to the first end of the third conducting line and the second, free end of the second conducting line is proximal, along the axis, to the second, free end of the third conducting line.

19. An antenna according to claim 1, wherein the axis is a single common axis passing through the first ends and second, free ends of the second and third conducting lines.

20. An antenna according to claim 1, wherein the first conducting line lies, in its entirety, along a first conducting line alignment axis.

* * * * *